US007974384B2

(12) United States Patent
Legall et al.

(10) Patent No.: US 7,974,384 B2
(45) Date of Patent: Jul. 5, 2011

(54) X-RAY TUBE HAVING A FERROFLUID SEAL AND METHOD OF ASSEMBLING SAME

(75) Inventors: Edwin L. Legall, Menomenee Falls, WI (US); Mark Alan Frontera, Ballston Lake, NY (US); Michael Scott Hebert, Franklin, WI (US)

(73) Assignee: General Electric Company, Schenectady, NY (US)

( * ) Notice: Subject to any disclaimer, the term of this patent is extended or adjusted under 35 U.S.C. 154(b) by 108 days.

(21) Appl. No.: 12/423,484

(22) Filed: Apr. 14, 2009

(65) Prior Publication Data

US 2010/0260323 A1 Oct. 14, 2010

(51) Int. Cl.
*H01J 35/00* (2006.01)

(52) U.S. Cl. ..... 378/133; 378/130

(58) Field of Classification Search ..... 378/132, 378/133, 130

See application file for complete search history.

(56) References Cited

U.S. PATENT DOCUMENTS

| | | | | |
|---|---|---|---|---|
| 4,405,876 | A | 9/1983 | Iversen | |
| 4,455,504 | A | 6/1984 | Iversen | |
| 4,501,566 | A * | 2/1985 | Carlson et al. | 313/40 |
| 4,577,340 | A | 3/1986 | Carlson et al. | |
| 4,584,699 | A | 4/1986 | LaFiandra et al. | |
| 4,622,687 | A * | 11/1986 | Whitaker et al. | 378/130 |
| 4,625,324 | A | 11/1986 | Blaskis et al. | |
| 4,688,239 | A * | 8/1987 | Schaffner et al. | 378/141 |
| 5,077,781 | A * | 12/1991 | Iversen | 378/132 |
| 5,340,122 | A | 8/1994 | Toboni et al. | |
| 5,838,762 | A * | 11/1998 | Ganin et al. | 378/125 |
| 6,192,107 | B1 * | 2/2001 | Price et al. | 378/130 |
| 7,197,115 | B2 | 3/2007 | Unger et al. | |
| 7,248,673 | B2 | 7/2007 | Miller | |
| 7,327,828 | B1 | 2/2008 | Frontera et al. | |
| 7,508,916 | B2 | 3/2009 | Frontera et al. | |
| 7,519,158 | B2 | 4/2009 | Gadre et al. | |
| 2003/0021378 | A1 * | 1/2003 | Noonan et al. | 378/132 |
| 2008/0107236 | A1 | 5/2008 | Gadre et al. | |
| 2008/0260105 | A1 | 10/2008 | Schaefer et al. | |
| 2010/0260324 | A1 * | 10/2010 | Legall et al. | 378/130 |

* cited by examiner

*Primary Examiner* — Chih-Cheng G Kao
(74) *Attorney, Agent, or Firm* — Ziolkowski Patent Solutions Group, SC

(57) ABSTRACT

An x-ray tube includes a vacuum enclosure, a shaft having a first end and a second end, a flange attached to the first end of the shaft, the flange having an outer perimeter, and a ferrofluid seal assembly having an inner bore, the inner bore having an outer perimeter smaller than the outer perimeter of the flange. The shaft is inserted through the bore of the ferrofluid seal assembly such that the ferrofluid seal assembly is positioned between the first end of the shaft and the second end of the shaft and such that the first end extends into the vacuum enclosure, and the ferrofluid seal is configured to fluidically seal the vacuum enclosure from an environment into which the second end of the shaft extends.

20 Claims, 7 Drawing Sheets

X-RAY TUBE HAVING A FERROFLUID SEAL AND METHOD OF ASSEMBLING SAME

BACKGROUND OF THE INVENTION

The invention relates generally to x-ray tubes and, more particularly, to a ferrofluid seal in an x-ray tube and a method of assembling same.

X-ray systems typically include an x-ray tube, a detector, and a bearing assembly to support the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The detector then emits data received, and the system translates the radiation variances into an image, which may be used to evaluate the internal structure of the object. One skilled in the art will recognize that the object may include, but is not limited to, a patient in a medical imaging procedure and an inanimate object as in, for instance, a package in a computed tomography (CT) package scanner.

X-ray tubes include a rotating anode structure for distributing the heat generated at a focal spot. The anode is typically rotated by an induction motor having a cylindrical rotor built into a cantilevered axle that supports a disc-shaped anode target and an iron stator structure with copper windings that surrounds an elongated neck of the x-ray tube. The rotor of the rotating anode assembly is driven by the stator. An x-ray tube cathode provides a focused electron beam that is accelerated across a cathode-to-anode vacuum gap and produces x-rays upon impact with the anode. Because of the high temperatures generated when the electron beam strikes the target, it is typically necessary to rotate the anode assembly at high rotational speed. This places stringent demands on the bearing assembly, which typically includes tool steel ball bearings and tool steel raceways positioned within the vacuum region, thereby requiring lubrication by a solid lubricant such as silver. In addition, the rotor, as well, is placed in the vacuum region of the x-ray tube. Wear of the silver and loss thereof from the bearing contact region increases acoustic noise and slows the rotor during operation. Placement of the bearing assembly in the vacuum region prevents lubricating with wet bearing lubricants, such as grease or oil, and performing maintenance on the bearing assembly to replace the solid lubricant.

In addition, the operating conditions of newer generation x-ray tubes have become increasingly aggressive in terms of stresses because of G forces imposed by higher gantry speeds and higher anode run speeds. As a result, there is greater emphasis in finding bearing solutions for improved performance under the more stringent operating conditions. Placing the bearing assembly and rotor outside the vacuum region of the x-ray tube by use of a hermetic rotating seal such as a ferrofluid seal allows the use of wet lubricants, such as grease or oil, to lubricate the bearing assembly.

A ferrofluid seal typically includes a series of annular regions between a rotating component and a non-rotating component. The annular regions are occupied by a ferrofluid that is typically a hydrocarbon-based or fluorocarbon-based oil with a suspension of magnetic particles therein. The particles are coated with a stabilizing agent, or surfactant, which prevents agglomeration of the particles and allows the particles to remain in suspension in the matrix fluid. When in the presence of a magnetic field, the ferrofluid is polarized and is caused to form a seal between each of the annular regions. The seal on each annular region, or stage, can separately withstand pressure of typically 1-3 psi and, when each stage is placed in series, the overall assembly can withstand pressure varying from atmospheric pressure on one side to high vacuum on the other side.

The ferrofluid seal allows rotation of a shaft therein designed to deliver mechanical power from the motor to the anode. As such, the motor rotor may be placed outside the vacuum region to enable a conventional grease-lubricated or oil-lubricated bearing assembly to be placed on the same side of the seal as the rotor to support the target. Furthermore, such bearings may be larger than those typically used on the vacuum side.

During operation, coolant passing through the shaft may serve as coolant for the conventional bearings or for cooling the ferrofluid seal below its design limit. The target, too, may be cooled via the coolant in the shaft. However, because heat generated in the target passes to the shaft via conduction heat transfer, the amount of heat passing from the target to the shaft may be limited due to thermal resistance at the attachment point between the target and the shaft. The amount of thermal resistance at the attachment point may be affected by the means with which the target is attached to the shaft.

Typically, ferrofluid spindles or assemblies are fabricated and pre-assembled by first attaching bearings to a centershaft, applying the sealing fluid to the centershaft, and then inserting the centershaft, target end first, through an aperture of the assembly from the pressure end of the assembly to the vacuum end of the assembly. However, in order to do so, the target end of centershaft must be smaller than the aperture of the ferrofluid assembly. Thus, the target is typically attached to the centershaft at an attachment point at the end of the shaft after the shaft is first passed through the aperture. Because of proximity of the attachment point to the ferrofluid seal and because the ferrofluid of the seal is limited in the temperature to which it can be raised, attaching the target to the target end of the centershaft precludes attachment via attachment methods that include heating of components—such as welding, brazing, and the like.

Thus, in a typical design, the target is attached to the centershaft via a hole in the target that is no larger than the centershaft. Examples of such attachment may include a threaded end on the centershaft and a matching thread in the target hole at the center of the target or may include a threaded end of the centershaft passing through the hole of the target and having a fastener such as a nut to secure the target to the centershaft. Such joints typically include a thermal resistance at the attachment joint that prevents adequate heat from conducting therethrough, thus serving as a conduction limiter or "bottleneck" in the design.

Therefore, it would be desirable to design an x-ray tube having a ferrofluid assembly therein, and method of assembly thereof, having an improved conduction resistance between the target and the centershaft.

BRIEF DESCRIPTION OF THE INVENTION

The invention provides an apparatus for improving an x-ray tube with a ferrofluid seal, and method of assembling same, that overcomes the aforementioned drawbacks.

According to one aspect of the invention, an x-ray tube includes a vacuum enclosure, a shaft having a first end and a second end, a flange attached to the first end of the shaft, the flange having an outer perimeter, and a ferrofluid seal assembly having an inner bore, the inner bore having an outer perimeter smaller than the outer perimeter of the flange. The shaft is inserted through the bore of the ferrofluid seal assembly such that the ferrofluid seal assembly is positioned between the first end of the shaft and the second end of the shaft and such that the first end extends into the vacuum enclosure, and the ferrofluid seal is configured to fluidically seal the vacuum enclosure from an environment into which the second end of the shaft extends.

In accordance with another aspect of the invention, a method of assembling an x-ray tube includes providing a ferrofluid seal assembly having an inner surface, the ferrofluid seal assembly having a vacuum end and an atmospheric pressure end and having an aperture passing from the vacuum end to the atmospheric end, providing a shaft having a first end, a second end, and a flange at the first end, and inserting the second end of the shaft through the aperture from the vacuum end to the atmospheric pressure end.

Yet another aspect of the invention includes an imaging system that includes a detector and an x-ray tube. The x-ray tube includes a shaft having a rim coupled to a first end of the shaft, the rim projecting radially and having an outer diameter, a target coupled to the rim, and a hermetic seal assembly having a cylindrically-shaped inner surface and a seal positioned between the inner surface of the seal and the outer diameter of the shaft, the hermetic seal assembly positioned between the first end of the shaft and a second end of the shaft. The outer diameter of the rim is larger than a diameter of the inner surface of the hermetic seal assembly.

Various other features and advantages of the invention will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION

Figure 1:
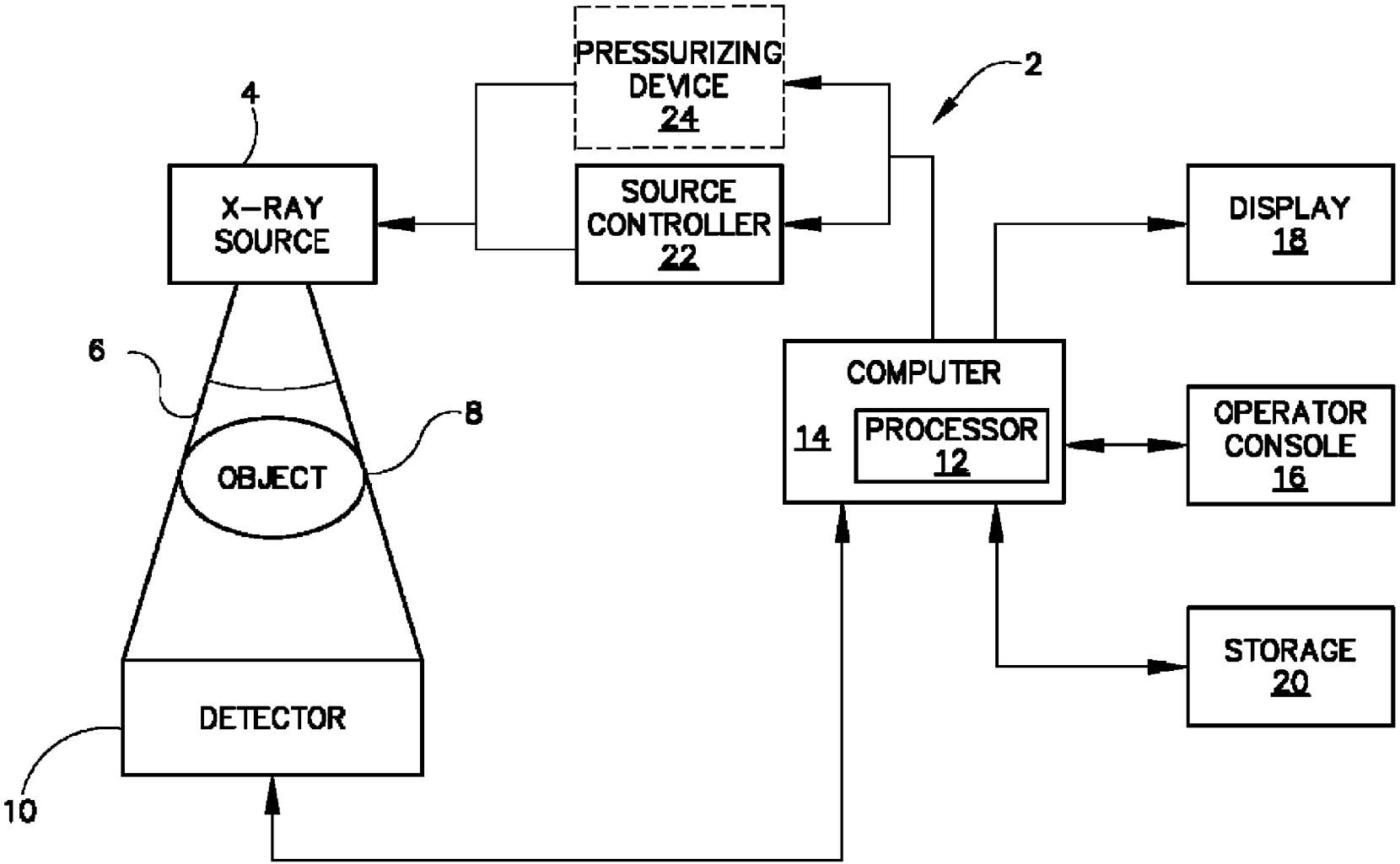
FIG. 1 is a block diagram of an imaging system that can benefit from incorporation of an embodiment of the invention.

FIG. 1 is a block diagram of an embodiment of an x-ray imaging system 2 designed both to acquire original image data and to process the image data for display and/or analysis in accordance with the invention. It will be appreciated by those skilled in the art that the invention is applicable to numerous medical imaging systems implementing an x-ray tube, such as x-ray or mammography systems. Other imaging systems such as computed tomography (CT) systems and digital radiography (RAD) systems, which acquire image three dimensional data for a volume, also benefit from the invention. The following discussion of imaging system 2 is merely an example of one such implementation and is not intended to be limiting in terms of modality.

As shown in FIG. 1, imaging system 2 includes an x-ray tube or source 4 configured to project a beam of x-rays 6 through an object 8. Object 8 may include a human subject, pieces of baggage, or other objects desired to be scanned. X-ray source 4 may be a conventional x-ray tube producing x-rays having a spectrum of energies that range, typically, from 30 keV to 200 keV. The x-rays 6 pass through object 8 and, after being attenuated by the object, impinge upon a detector 10. Each detector in detector 10 produces an analog electrical signal that represents the intensity of an impinging x-ray beam, and hence the attenuated beam, as it passes through the object 8. In one embodiment, detector 10 is a scintillation based detector, however, it is also envisioned that direct-conversion type detectors (e.g., CZT detectors, etc.) may also be implemented.

A processor 12 receives the signals from the detector 10 and generates an image corresponding to the object 8 being scanned. A computer 14 communicates with processor 12 to enable an operator, using operator console 16, to control the scanning parameters and to view the generated image. That is, operator console 16 includes some form of operator interface, such as a keyboard, mouse, voice activated controller, or any other suitable input apparatus that allows an operator to control the imaging system 2 and view the reconstructed image or other data from computer 14 on a display unit 18. Additionally, operator console 16 allows an operator to store the generated image in a storage device 20 which may include hard drives, flash memory, compact discs, etc. The operator may also use operator console 16 to provide commands and instructions to computer 14 for controlling a source controller 22 that provides power and timing signals to x-ray source 4. In one embodiment, imaging system 2 includes a pressurizing device 24 (shown in phantom) that is external to x-ray source 4 and configured to pressurize a coolant and feed it to x-ray source 4, as will be described.

Figure 2:
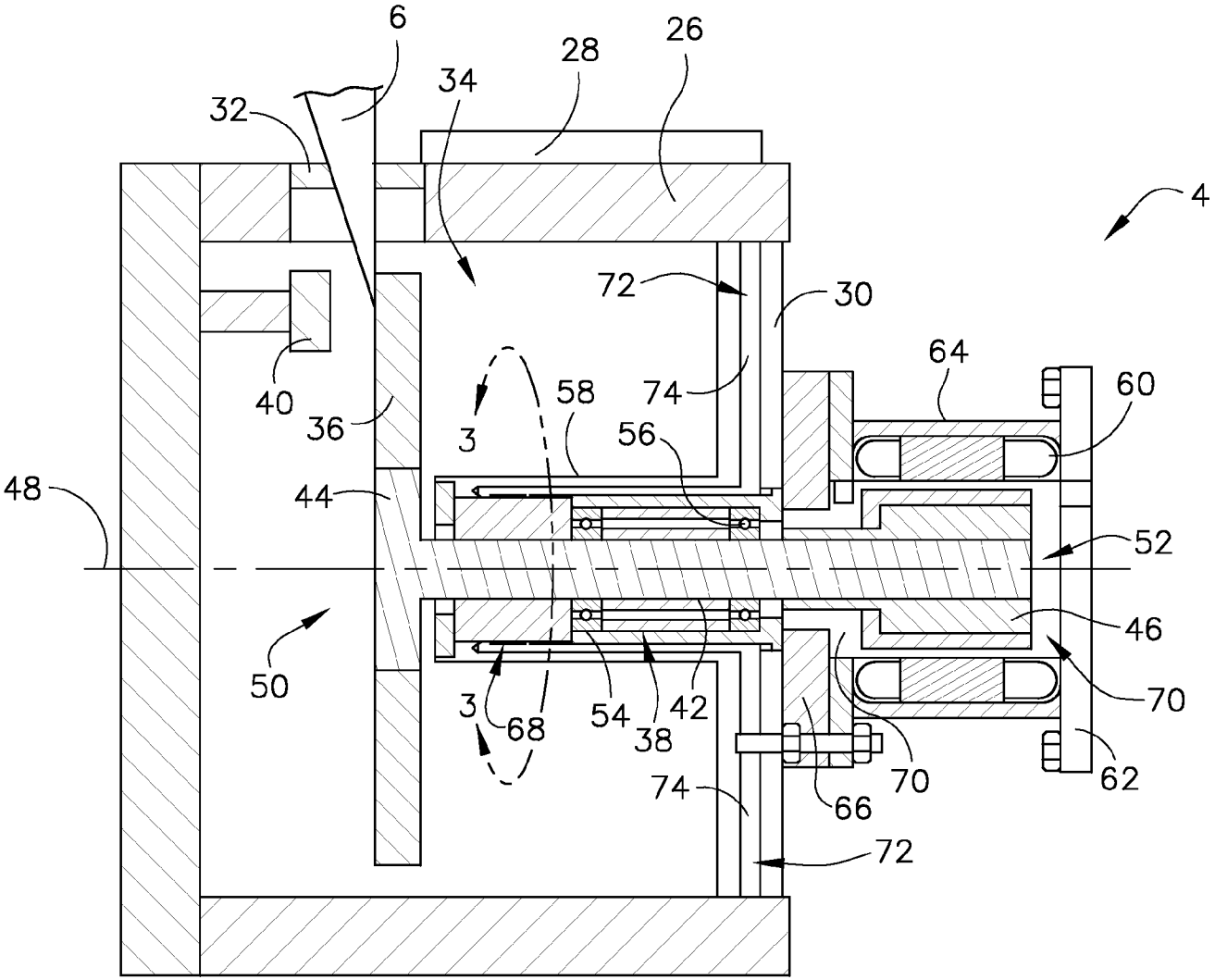
FIG. 2 illustrates a cross-sectional view of an x-ray tube according to an embodiment of the invention.

FIG. 2 illustrates a cross-sectional view of x-ray source 4 incorporating embodiments of the invention. The x-ray source 4 includes a frame 26, a mount structure 28, and an anode backplate 30. Mount structure 28 is configured to attach x-ray source 4 to an imaging system, such as imaging system 2 of FIG. 1. A radiation emission passage 32 allows x-rays 6 to pass therethrough. Frame 26 and anode backplate 30 enclose an x-ray tube vacuum volume 34, which houses a target, or anode 36, a bearing assembly 38, and a cathode 40. A center shaft 42 includes a flange 44 attached to anode 36 via welding, brazing, a bolted joint, and the like.

X-rays 6 are produced when high-speed electrons are suddenly decelerated when directed from the cathode 40 to the anode 36 via a potential difference therebetween of, for example, 60 thousand volts or more in the case of CT applications. The x-rays 6 are emitted through radiation emission passage 32 toward a detector array, such as detector 10 of FIG. 1. To avoid overheating the anode 36 from the electrons, a rotor 46 and center shaft 42 rotate the anode 36 at a high rate of speed about a centerline 48 at, for example, 90-250 Hz. Anode 36 is attached to center shaft 42 at a first end 50, and the rotor 46 is attached to center shaft 42 at a second end 52.

The bearing assembly 38 includes a front bearing 54 and a rear bearing 56, which support center shaft 42 to which anode 36 is attached. In a preferred embodiment, front and rear bearings 54, 56 are lubricated using grease or oil. Front and rear bearings 54, 56 are attached to center shaft 42 and are mounted in a stem or bearing housing 58, which is supported by anode backplate 30. A stator 60 rotationally drives rotor 46 attached to center shaft 42, which rotationally drives anode 36.

A mounting plate 62, a stator housing 64, a stator mount structure 66, stem 58, and a ferrofluid seal assembly 68 surround an antechamber 70 into which bearing assembly 38 and rotor 46 are positioned and into which the second end 52 of center shaft 42 extends. Center shaft 42 extends from antechamber 70, through ferrofluid seal assembly 68, and into x-ray tube vacuum volume 34 and may include a coolant line or passageway therein (not shown in FIG. 2), and center shaft 42 may include an impeller attached thereto, as will be discussed below. The ferrofluid seal assembly 68 hermetically seals x-ray tube vacuum volume 34 from antechamber 70. A cooling passage 72 carries coolant 74 through anode backplate 30 and into stem 58 to cool ferrofluid seal assembly 68 thermally connected to stem 58.

In addition to the rotation of the anode 36 within x-ray source 4, in a CT application, the x-ray source 4 as a whole is caused to rotate about an object at rates of, typically, 1 Hz or faster. The rotational effects of both cause the anode 36 weight to be compounded significantly, hence leading to large operating contact stresses in the bearings 54, 56.

Figure 3:
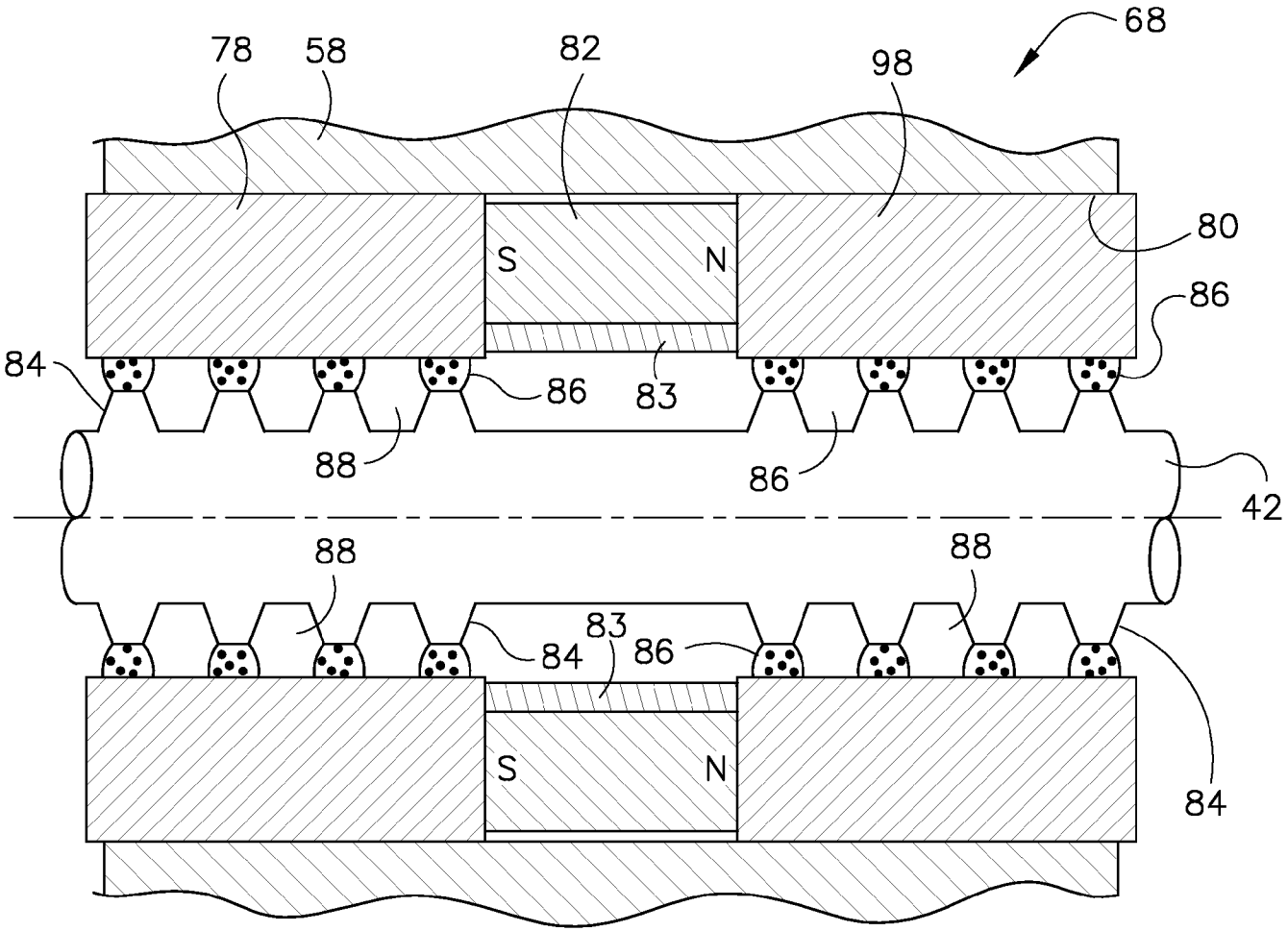
FIG. 3 illustrates a cross-sectional view of a ferrofluid seal assembly according to the invention.

FIG. 3 illustrates a cross-sectional view of the ferrofluid seal assembly 68 of FIG. 2. A pair of annular pole pieces 76, 78 abut an interior surface 80 of stem 58 and encircle center shaft 42. An annular permanent magnet 82 is positioned to include a magnet or pole spacer 83 between annular pole piece 76 and annular pole piece 78. In embodiments of the invention, pole pieces 76, 78 and magnet spacer 83 are brazed, welded, or machined as a single piece, forming a hermetic assembly. In a preferred embodiment, center shaft 42 includes annular rings 84 extending therefrom toward annular pole pieces 76, 78. Alternatively, however, annular pole pieces 76, 78 may include annular rings extending toward center shaft 42 instead of, or in addition to, annular rings 84 of center shaft 42. A ferrofluid 86 is positioned between each annular ring 84 and corresponding annular pole pieces 76, 78, thereby forming cavities 88. Magnetization from annular permanent magnet 82 retains the ferrofluid 86 positioned between each annular ring 84 and corresponding annular pole pieces 76, 78 in place. In this manner, multiple stages of ferrofluid 86 are formed that hermetically seal the pressure of gas in the antechamber 70 of FIG. 2 from a high vacuum formed in x-ray tube vacuum volume 34. As shown, FIG. 3 illustrates 8 stages of ferrofluid 86. Each stage of ferrofluid 86 withstands 1-3 psi of gas pressure. Accordingly, one skilled in the art will recognize that the number of stages of ferrofluid 86 may be increased or decreased, depending on the difference in pressure between the antechamber 70 and the x-ray tube vacuum volume 34.

Figure 4:
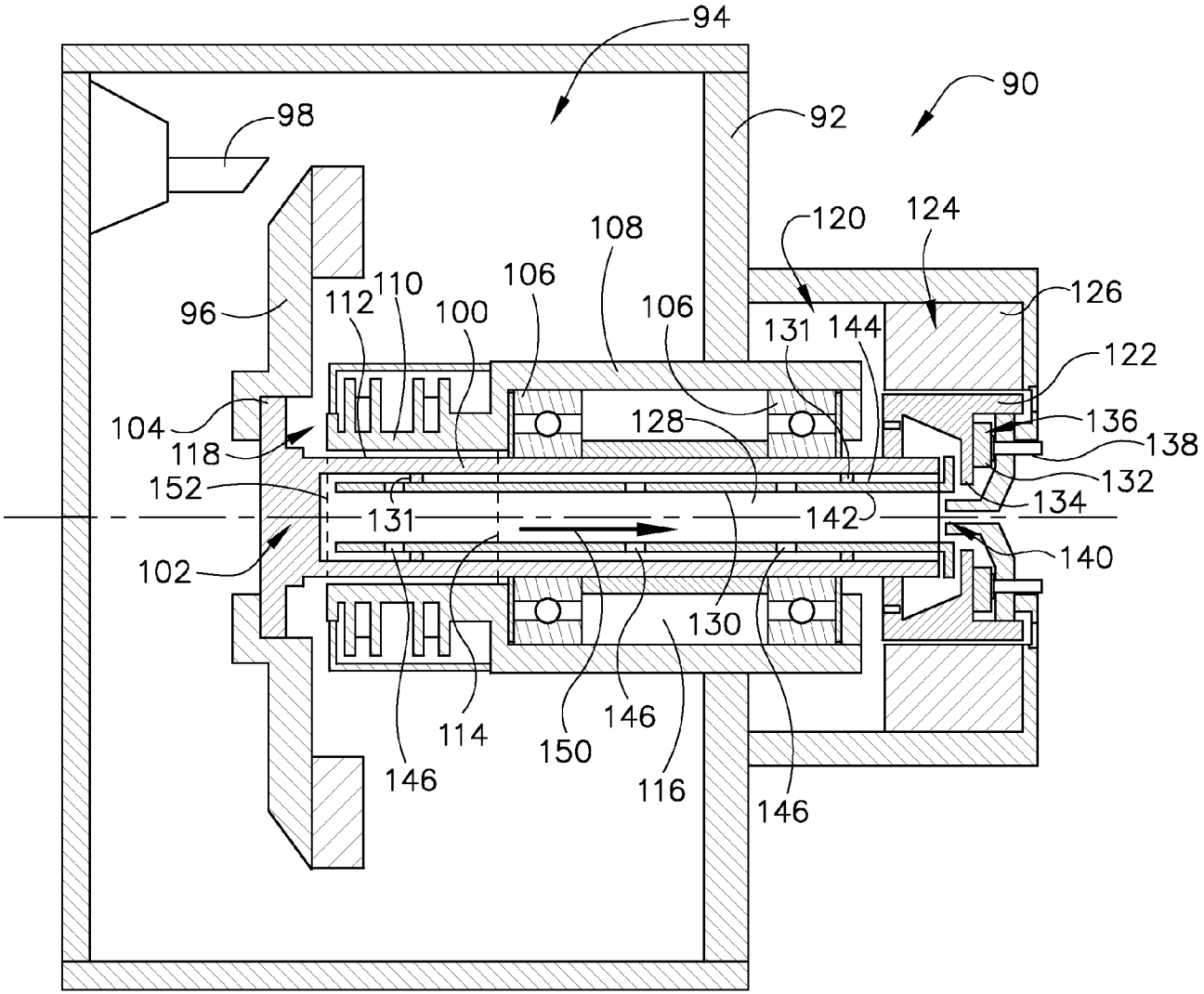
FIG. 4 illustrates a cross-sectional view of an x-ray tube according to an embodiment of the invention.

FIG. 4 illustrates an x-ray tube according to an embodiment of the invention. X-ray tube 90 includes a vacuum enclosure or frame 92 that contains a vacuum 94 and encloses an anode or target 96 and a cathode 98. Target 96 is coupled to and supported by a shaft 100 at a first end 102 thereof, and in embodiments of the invention, the coupling is via a bolted joint, a welded joint, a braze joint, and the like. Shaft 100 is coupled to target 96 via a rim or flange 104. In one embodiment, flange 104 and shaft 100 are fabricated from a single material, and in another embodiment, flange 104 is attached to shaft 100 via a braze joint, a weld joint, and the like.

Shaft 100 is supported by bearings 106 that are housed in a stem 108. A single-stage or multi-stage ferrofluid seal assembly 110 includes an aperture 112 therein, the aperture having a diameter 114. Ferrofluid seal assembly 110 is positioned between target 96 and bearings 106 and is configured to fluidically separate vacuum 94 from an environment 116. Thus, ferrofluid seal assembly 110 includes a vacuum end 118 and an atmospheric pressure or pressurized end 120, the pressure end 120 in fluidic contact with environment 116. Environment 116 contains bearings 106 and a rotor 122, and rotor 122 is attached to shaft 100 at a second end 124. A stator 126 is positioned proximately to rotor 122. In one embodiment, shaft 100 includes an opening, passageway or aperture 128, and a diffuser or tube wall 130 that is stationary with respect to frame 92 of x-ray tube 90 or rotating having a shaft internally supported by annular supports 131 that form partial axial passages and which allow cooling fluid to pass therethrough. Wall 130 is positioned to separate flow such that an inlet is formed inside wall 130 and an outlet is formed outside wall 130. An impeller 132 is attached to rotor 122 via an impeller mounting structure 134, and a region 136 proximate impeller 132 is fed by a coolant or gas (such as air or an inert gas such as nitrogen, argon, and the like) via a coolant supply line 138. In an embodiment of the invention, impeller 132 causes coolant to be pressurized and to flow into aperture 128 as will be discussed below. While impeller 132 is illustrated as being attached to rotor 122 via mounting structure 134, impeller 132 may be attached to any of the rotating components therein, thus being caused to rotate and pressurize the coolant.

Thus, in operation, as anode 96 is caused to rotate via rotor 122, impeller 132 rotates therewith, causing the coolant to pressurize and pass into aperture 128 at an inlet 140 and to flow along shaft 100 and along an inner diameter 142 of stationary or rotatable wall 130 to first end 102. The coolant then passes along an outer diameter 144 of stationary or rotatable wall 130 and out to environment 116 and therebeyond. In one embodiment, impeller 132 is foregone, and an impeller external to x-ray tube 90 (such as pressurizing device 24 of FIG. 1) is used as the motive mechanical power behind the coolant, causing it to flow therein. As such, coolant passing therein causes ferrofluid seal assembly 110 and bearings 106 to decrease in temperature, while drawing heat from anode 96 via flange 104. In one embodiment, stationary or rotatable wall 130 includes jets or apertures 146 therein that are positioned to impinge coolant and enhance turbulence in preferred locations of shaft 100, such as in the region of the ferrofluid seal assembly 110 or in the region of the bearings 106. Thus, as coolant passes through aperture 128 of shaft 100, convective heat transfer occurs which increases rates of heat transfer above that of typical conduction in metal. The convection may be increased by increasing the heat transfer coefficients therein by providing jets or apertures 146. In another embodiment, gas is pressurized prior to entering coolant supply line 138 via a pressurizing device 24 that is external to x-ray source 4 and may be part of imaging system 2.

Figure 5:
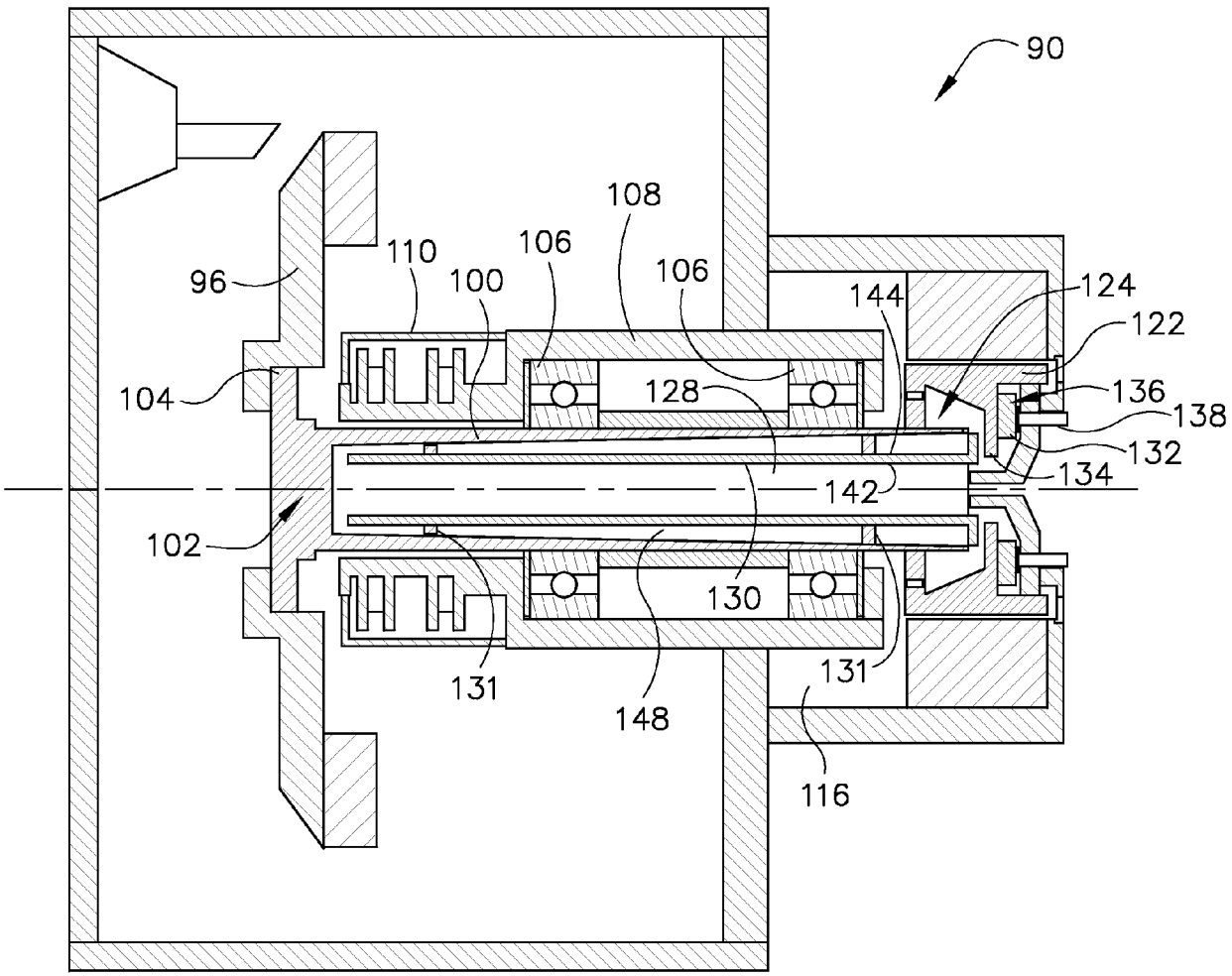
FIG. 5 illustrates a cross-sectional view of an x-ray tube according to an embodiment of the invention.

FIG. 5 illustrates x-ray tube 90 according to another embodiment of the invention. As with FIG. 4, x-ray tube 90 includes ferrofluid seal assembly 110 having shaft 100 passing therethrough, shaft 100 having flange 104 at first end 102 and rotor 122 at second end 124. Shaft 100 includes bearings 106 that are housed in stem 108. Impeller 132 is attached to shaft 100 via impeller mounting structure 134, and target 96 is attached to flange 104. However, in this embodiment, shaft 100 includes a tapered aperture 148, which increases in diameter in a direction from the first end 102 to the second end 124. Tapered aperture 148 is configured to ease flow of a coolant to pass therethrough due to coolant buoyancy, and shaft 100 includes stationary or rotatable wall 130 passing therein.

Thus, in operation, anode 96 is caused to rotate via rotor 122 and impeller 132 rotates therewith, causing coolant to pressurize and pass into tapered aperture 148. The coolant passes along shaft 100 and along inner diameter 142 of stationary wall 130 to first end 102, then passes along outer diameter 144 of stationary wall 130 and out to environment 116 and therebeyond. However, in this embodiment, because of the taper of tapered aperture 148, coolant passes therethrough having a reduced pressure drop when compared to, for instance, coolant passing through aperture 128 of FIG. 4 and takes advantage of coolant buoyancy, as understood by those skilled in the art. In addition, because of the tapered nature of tapered aperture 148 and the resulting variable thickness of shaft 100 along its length, one skilled in the art will recognize that favorable rotordynamic behavior may result, as well, such that a natural frequency of shaft 100 may be different from a runspeed of shaft 100.

Referring back to FIG. 4, x-ray tube 90 is configured to be assembled by inserting second end 124 of shaft 100 through ferrofluid seal assembly 110 in a direction 150, wherein shaft 100 first passes through ferrofluid seal assembly 110 and then through stem 108. As such, a maximum diameter 152 of shaft 100 is selected such that shaft 100 is insertable through aperture 128 of ferrofluid seal assembly 110 without interference.

Figure 6:
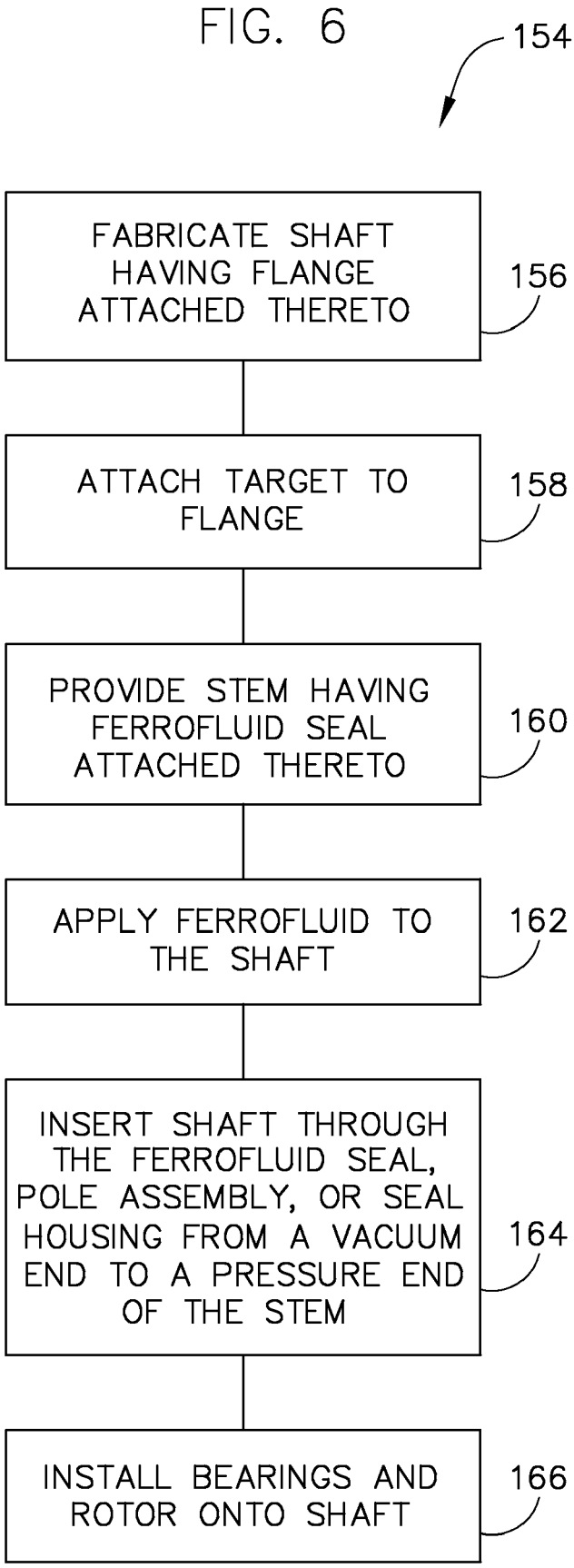
FIG. 6 illustrates an assembly procedure according to an embodiment of the invention.

FIG. 6 illustrates an assembly procedure 154 for anode 36 of x-ray tube 90 according to an embodiment of the invention. According to this embodiment, shaft 100 is fabricated having flange 104 attached thereto at step 156. According to one embodiment of the invention, shaft 100 is first fabricated having flange 104 attached thereto via a weld joint, a braze joint, and the like. According to another embodiment of the invention, the shaft/flange combination 100/104 is fabricated from a single piece of material, such as a stainless steel. The target 96 may be attached to flange 104 at 158. However, it is contemplated that target 96 may be instead be attached to flange 104 after any of steps 160-166 in process 154. At step 160, stem 108 is provided having ferrofluid seal assembly 110 attached thereto. Ferrofluid is applied to the shaft 100 at step 162, and the shaft 100 is inserted through the ferrofluid seal assembly 110 from the vacuum end 118 toward the pressure end 120 at step 164. After the shaft is inserted at step 164, bearings 106 and rotor 122 are attached to shaft 100 at step 166. Thus, because shaft 100 is inserted from the vacuum end 118 toward the pressure end 120, target 96 may be attached to flange 104 prior to or after inserting shaft 100 through ferrofluid seal assembly 110 at step 164.

Figure 7:
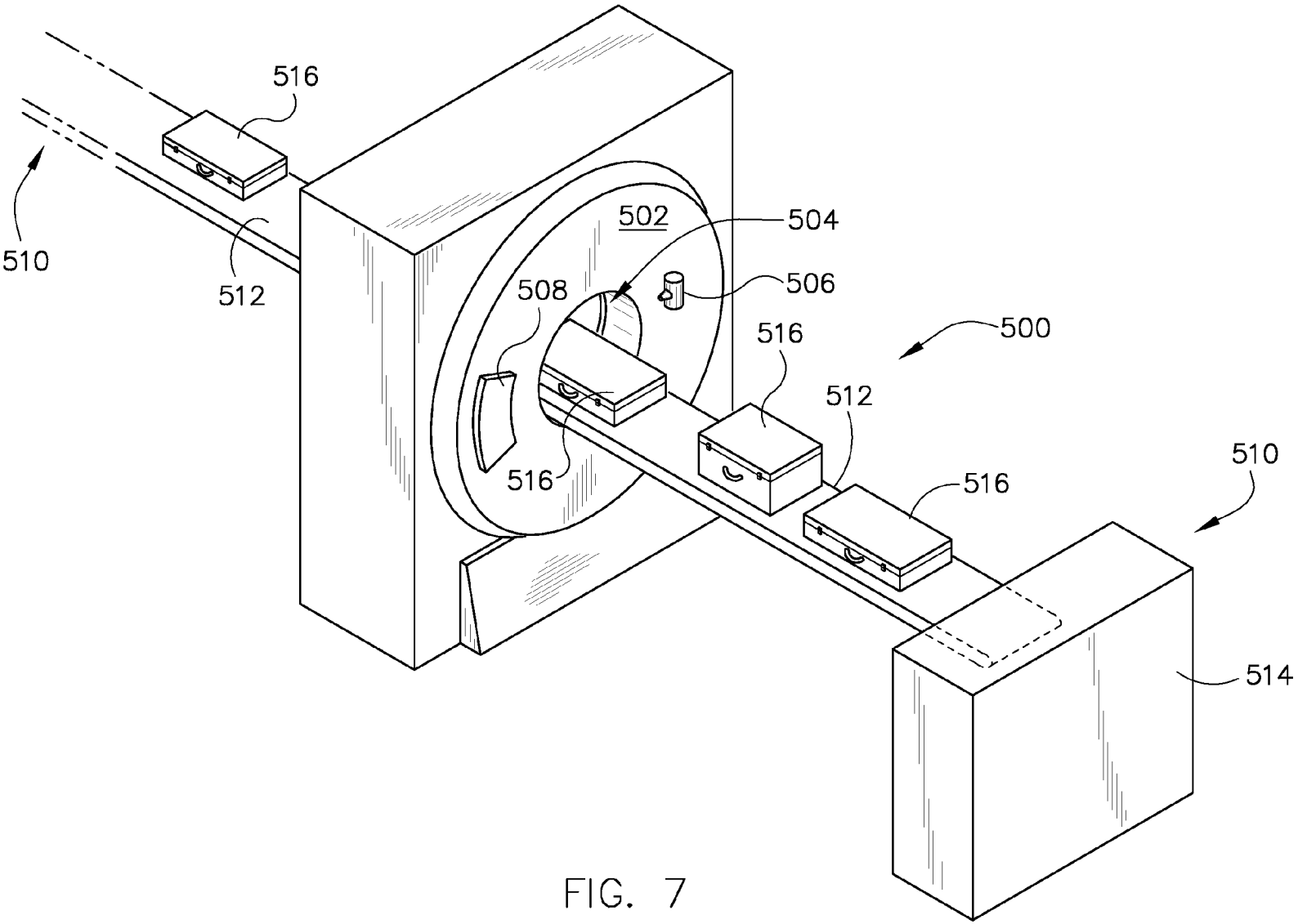
FIG. 7 is a pictorial view of an x-ray system for use with a non-invasive package inspection system incorporating embodiments of the invention.

FIG. 7 is a pictorial view of an x-ray system 500 for use with a non-invasive package inspection system. The x-ray system 500 includes a gantry 502 having an opening 504 therein through which packages or pieces of baggage may pass. The gantry 502 houses a high frequency electromagnetic energy source, such as an x-ray tube 506, and a detector assembly 508. A conveyor system 510 is also provided and includes a conveyor belt 512 supported by structure 514 to automatically and continuously pass packages or baggage pieces 516 through opening 504 to be scanned. Objects 516 are fed through opening 504 by conveyor belt 512, imaging data is then acquired, and the conveyor belt 512 removes the packages 516 from opening 504 in a controlled and continuous manner. As a result, postal inspectors, baggage handlers, and other security personnel may non-invasively inspect the contents of packages 516 for explosives, knives, guns, contraband, etc. One skilled in the art will recognize that gantry 502 may be stationary or rotatable. In the case of a rotatable gantry 502, system 500 may be configured to operate as a CT system for baggage scanning or other industrial or medical applications.

Thus, because of the improved assembly procedure, x-ray tube 90 includes a flange 104 that is larger than the aperture 112 that passes through ferrofluid seal assembly 110. Flange 104 may include a diameter having an increased amount of surface contact area with target 96 as compared with prior art devices and may also accommodate a bolted joint, as an example. Such an increase in surface contact area improves conduction heat transfer through the joint, allowing an increased amount of heat to conduct to shaft 100. Thus, coolant passing through shaft 100 may not only serve to cool the ferrofluid seal assembly 110 and the bearings 106, but also to extract additional heat from the target 96.

In addition, because the target 96 may be attached to flange 104 prior to assembly of the shaft 100 into aperture 112, target 96 may be attached to flange 104 via high temperature processes such as brazing and welding, as examples, to minimize negative effects to the ferrofluid of ferrofluid seal assembly 110.

Further, because of the impeller 132 mounted at second end 124 of shaft 100, air or other coolant may be forced or pressurized into a cavity or aperture 128 during operation of x-ray tube 90 and rotation of target 96, thus further enhancing the cooling of target 96 and heat transfer along shaft 100.

Therefore, according to one embodiment of the invention, an x-ray tube includes a vacuum enclosure, a shaft having a first end and a second end, a flange attached to the first end of the shaft, the flange having an outer perimeter, and a ferrofluid seal assembly having an inner bore, the inner bore having an outer perimeter smaller than the outer perimeter of the flange. The shaft is inserted through the bore of the ferrofluid seal assembly such that the ferrofluid seal assembly is positioned between the first end of the shaft and the second end of the shaft and such that the first end extends into the vacuum enclosure, and the ferrofluid seal is configured to fluidically seal the vacuum enclosure from an environment into which the second end of the shaft extends.

In accordance with another embodiment of the invention, a method of assembling an x-ray tube includes providing a ferrofluid seal assembly having an inner surface, the ferrofluid seal assembly having a vacuum end and an atmospheric pressure end and having an aperture passing from the vacuum end to the atmospheric end, providing a shaft having a first end, a second end, and a flange at the first end, and inserting the second end of the shaft through the aperture from the vacuum end to the atmospheric pressure end.

Yet another embodiment of the invention includes an imaging system that includes a detector and an x-ray tube. The x-ray tube includes a shaft having a rim coupled to a first end of the shaft, the rim projecting radially and having an outer diameter, a target coupled to the rim, and a hermetic seal assembly having a cylindrically-shaped inner surface and a seal positioned between the inner surface of the seal and the outer diameter of the shaft, the hermetic seal assembly positioned between the first end of the shaft and a second end of the shaft. The outer diameter of the rim is larger than a diameter of the inner surface of the hermetic seal assembly.

The invention has been described in terms of the preferred embodiment, and it is recognized that equivalents, alternatives, and modifications, aside from those expressly stated, are possible and within the scope of the appending claims.

What is claimed is:

1. An x-ray tube comprising:

a vacuum enclosure;

a shaft having a first end and a second end, wherein the shaft includes a passageway therein and an opening to the passageway at the second end, and wherein the passageway is tapered along an axis from the first end to the second end;

a diffuser positioned within the passageway and forming a gap between an outer wall of the diffuser and an inner wall of the passageway, the diffuser configured to pass a coolant therethrough;

a flange attached to the first end of the shaft, the flange having an outer perimeter; and a ferrofluid seal assembly having an inner bore, the inner bore having an outer perimeter smaller than the outer perimeter of the flange;

wherein the shaft is inserted through the bore of the ferrofluid seal assembly such that the ferrofluid seal assembly is positioned between the first end of the shaft and the second end of the shaft and such that the first end extends into the vacuum enclosure; and wherein the ferrofluid seal is configured to fluidically seal the vacuum enclosure from an environment into which the second end of the shaft extends.

2. The x-ray tube of claim 1 wherein the flange is attached to the first end of the shaft via one of welding and brazing.

3. The x-ray tube of claim 1 wherein the flange and the shaft are machined from a single piece of material.

4. The x-ray tube of claim 1 comprising a target coupled to the flange.

5. The x-ray tube of claim 4 wherein the target is bolted to the flange.

6. The x-ray tube of claim 1 wherein the ferrofluid seal is a multi-stage ferrofluid seal.

7. The x-ray tube of claim 1 wherein the shaft has an opening passing therethrough, the opening configured to allow a gas to pass from the second end of the shaft to the first end of the shaft.

8. The x-ray tube of claim 1 comprising an impeller attached to the shaft at the second end and configured to pressurize fluid into a passageway within the shaft.

9. A method of assembling an x-ray tube comprising:

providing a ferrofluid seal assembly having an inner surface, the ferrofluid seal assembly having a vacuum end and an atmospheric pressure end and having an aperture passing from the vacuum end to the atmospheric end;

providing a shaft having a first end, a second end, and a flange at the first end;

coupling support bearings to the shaft between the first end and the second end after inserting the shaft through the aperture of the ferrofluid seal assembly; and inserting the second end of the shaft through the aperture from the vacuum end to the atmospheric pressure end.

10. The method of claim 9 wherein the flange has an outer diameter that is larger than the aperture.

11. The method of claim 9 comprising coupling a target to the shaft via the flange.

12. The method of claim 11 wherein coupling a target comprises coupling the target to the flange via a bolted joint.

13. The method of claim 9 comprising forming a passageway through the shaft, the passageway configured to pass coolant therethrough.

14. The method of claim 9 comprising attaching the flange to the first end of the shaft via one of welding and brazing.

15. An imaging system comprising:

a detector; and an x-ray tube, the x-ray tube comprising:

a hollow shaft having a rim coupled to a first end of the shaft, the rim projecting radially and having an outer diameter;

a diffuser positioned within the hollow shaft and having one or more jets in a wall thereof that allow passage of fluid from inside the diffuser to a gap formed between the diffuser and a wall of an inner surface of the hollow shaft;

a target coupled to the rim; and a hermetic seal assembly having a cylindrically-shaped inner surface and a seal positioned between the inner surface of the seal and the outer diameter of the shaft, the hermetic seal assembly positioned between the first end of the shaft and a second end of the shaft;

wherein the outer diameter of the rim is larger than a diameter of the inner surface of the hermetic seal assembly.

16. The imaging system of claim 15 wherein the hermetic seal assembly comprises a ferrofluid seal.

17. The imaging system of claim 15 wherein the rim is coupled to the hollow shaft via one of a braze joint and a weld joint.

18. The imaging system of claim 15 wherein the target is coupled to the rim via a detachable joint.

19. The imaging system of claim 18 wherein the detachable joint comprises a plurality of bolts.

20. The imaging system of claim 15 comprising an impeller coupled to a second end of the hollow shaft and configured to feed a coolant into the hollow shaft upon rotation thereof.

* * * * *